US008056945B2

(12) United States Patent
Moreno

(10) Patent No.: US 8,056,945 B2
(45) Date of Patent: Nov. 15, 2011

(54) BAR SEAL FOR SHIPPING CONTAINER

(76) Inventor: Jose M. Moreno, Pembroke Pines, FL (US)

( * ) Notice: Subject to any disclaimer, the term of this patent is extended or adjusted under 35 U.S.C. 154(b) by 311 days.

(21) Appl. No.: 12/418,573

(22) Filed: Apr. 4, 2009

(65) Prior Publication Data

US 2010/0253098 A1 Oct. 7, 2010

(51) Int. Cl.
*B65D 55/06* (2006.01)
*B65D 55/00* (2006.01)

(52) U.S. Cl. ..... 292/321; 292/259 R; 292/DIG. 51; 292/DIG. 60; 70/14

(58) Field of Classification Search ..... 292/282, 292/288, 259 R, 256.6, 321, DIG. 51, DIG. 60; 70/14; 248/515
See application file for complete search history.

(56) References Cited

U.S. PATENT DOCUMENTS

| | | | | |
|---|---|---|---|---|
| D351,984 | S * | 11/1994 | Victor | D8/331 |
| 6,113,163 | A | 9/2000 | Liroff | |
| 6,331,022 | B1 * | 12/2001 | Liroff | 292/307 R |
| 6,536,815 | B1 * | 3/2003 | Liroff | 292/259 R |
| 6,553,797 | B2 * | 4/2003 | Witchey | 70/209 |
| D481,614 | S * | 11/2003 | Onel | D8/331 |
| 6,834,896 | B2 * | 12/2004 | Smith | 292/259 R |
| 7,044,512 | B1 | 5/2006 | Moreno | |
| 7,063,362 | B1 | 6/2006 | Liroff | |
| 7,272,963 | B2 * | 9/2007 | Rosenberg et al. | 70/126 |
| 7,278,663 | B2 * | 10/2007 | Witchey | 292/259 R |
| 7,380,846 | B1 | 6/2008 | Moreno | |

* cited by examiner

*Primary Examiner* — Carlos Lugo
(74) *Attorney, Agent, or Firm* — Ruben Alcoba, Esq.

(57) ABSTRACT

The present invention is directed to a bar seal for a shipping container that indicates if the bar seal has been tampered with during the shipment of goods. The bar seal uses the following mechanisms to indicate tampering: a unique marking mechanism, a reusable locking mechanism, and a temporary sealing mechanism for sealing a shipping container.

4 Claims, 10 Drawing Sheets

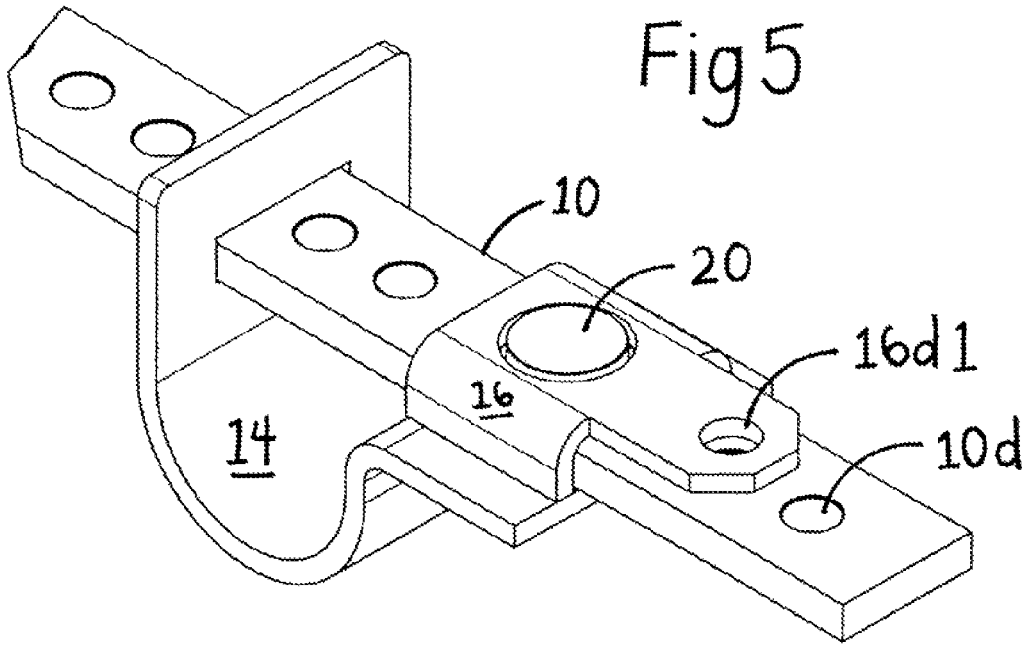
Fig 5
Fig 6
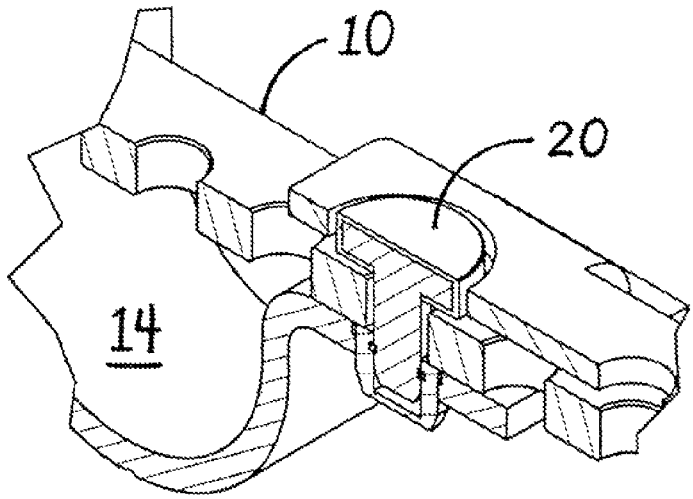

BAR SEAL FOR SHIPPING CONTAINER

BACKGROUND

The present invention relates to security systems and more particularly, to security bar seals for shipping containers.

Most bar seals for shipping containers are by necessity one time use bar seals. This is defined to mean that once a bar seal is locked on to a shipping container, the bar seal will have to be cut to open the container.

The present invention is directed to a bar seal that allows the user of the bar seal to use the bar seal with or without permanently locking the bar seal to the shipping container and at the same time provide a security mechanism that will allow the user not to have to cut the bar seal. The invention also provides a marking mechanism that will indicate tampering with the bar seals.

It is foreseen that the bar seal of the present invention will be used in two scenarios.

Scenario one, involves exporters sending goods in shipping containers from inland locations to seaports. In many countries, the goods transported by land will pass through check points wherein containers will be ordered opened by authorities prior to reaching seaports. In order to prevent theft, most exporters seal containers prior to shipping the containers by land. In most instances, when a container that has been sealed by a bar seal is ordered open, the bar seal will have to be cut and a new bar seal will have to be placed on the container. If there are many check points between the inland location and the seaport, then the costs associated with replacing the bar seals would be taxing on the exporter. An embodiment of the present invention will allow exporters to place temporary seals on the bar seals when transporting shipping containers by land, thereby allowing them to secure their containers without having them permanently sealed. Upon the containers reaching the seaport, the bar seals have a locking mechanism that permanently locks the containers after the containers are inspected.

Scenario two uses another embodiment of the present invention. The embodiment uses a reusable locking mechanism. This embodiment would be used when shipping containers by land. By using a marking mechanism along with the reusable locking mechanism and the temporary seal, transporters of shipping containers will prevent the containers from being compromised during shipment. Upon the containers reaching their final destination, the temporary seals would be cut, the reusable locking mechanisms would be opened, and the marking mechanisms would be checked to ensure that the bar seals were not compromised.

The inventor devised a marking mechanism that involves the assigning of random color codes to individual elements of the bar seals along with placing random specific codes on the elements of the bar seals. The codes are placed on the bar seals because thieves monitor shippers' behaviors. Thieves tend to work around the safeguards shippers put in place. By using the random color codes and placing the random specific codes on the individual elements of bar seals, he has devised a way of identifying any tampering with the bar seals, thereby reducing the chances that shipments protected with his bar seals will be compromised by thieves.

Several bar seals have been developed in the past, however, the inventor believes that the closest references correspond to his own U.S. patents and a pending U.S. patent application: U.S. Pat. No. 7,380,846 B1, issued on Jun. 3, 2008 for Bar Seal for Container; U.S. Pat. No. 7,044,512, issued on May 16, 2006 for Bar Seal for Shipping Container; and U.S. patent application Ser. No. 12/164,551, filed on Jun. 30, 2008 for Bar seal For Shipping Container. However, the above references differ from the present invention. Specifically, the present invention includes the following non-obvious tamper resistant elements: a marking mechanism; a reusable locking mechanism; and a temporary sealing mechanism for temporary sealing a shipping container.

For the foregoing reasons, there is a need for a bar seal having a unique marking mechanism, a reusable locking mechanism, and a temporary sealing mechanism for sealing a shipping container.

SUMMARY

The present invention is directed to a bar seal for a shipping container that indicates if the bar seal has been tampered with during the shipment of goods. The bar seal uses the following mechanisms to indicate tampering; a unique marking mechanism, a reusable locking mechanism, and a temporary sealing mechanism for sealing a shipping container.

The bar seal comprises of an elongated bar, a U-shaped bracket, a locking bracket, a mount, and a locking means. In one embodiment the locking means will be a pin and in another embodiment the locking means will be a lock.

In a further embodiment of this application, a temporary seal shall be used with the bar seal.

In an embodiment of the present invention, the elongated bar, the U-shaped bracket, and the locking bracket and mount shall be randomly assigned a color code and might be further uniquely marked.

An object of the present invention is to provide shippers with a unique marking mechanism.

Another object of the present invention is to provide shippers with a reusable bar seal when shipping containers by land.

A further object of the present invention is to allow shippers the ability to attach a temporary seal to reusable or one way bar seals.

Still a further object of the present invention is to allow shipper to identify tampering with a bar seal of shipping containers.

DRAWINGS

These and other features, aspects, and advantages of the present invention will become better understood with regard to the following description, appended claims, and drawings where:

FIG. 5 shows a perspective view of the elongated bar mounted on the locking bracket of the first embodiment of the present invention;

FIG. 6 shows a cross sectional view of the elongated bar mounted on the locking bracket of the present invention, wherein a pin functions as the locking means of the first embodiment;

DESCRIPTION

Figure 1:
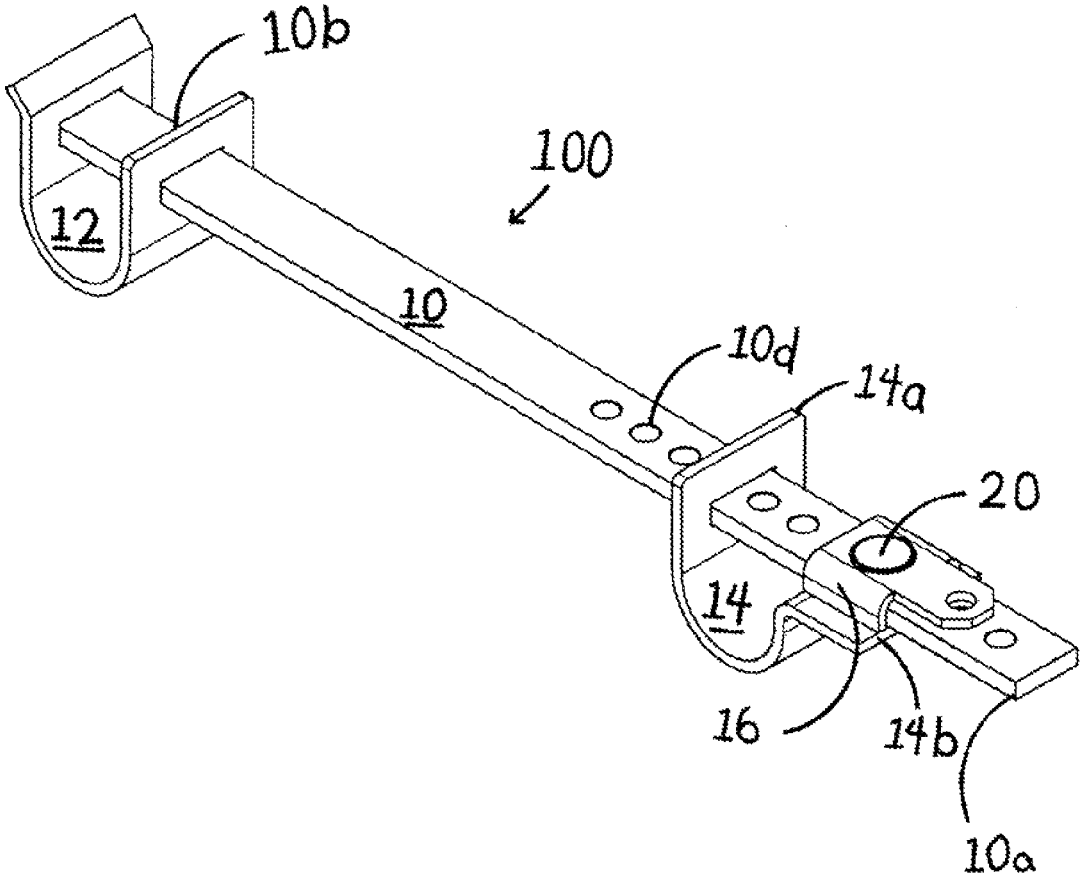
FIG. 1 shows a perspective view of a first embodiment of the present invention.
Figure 2:
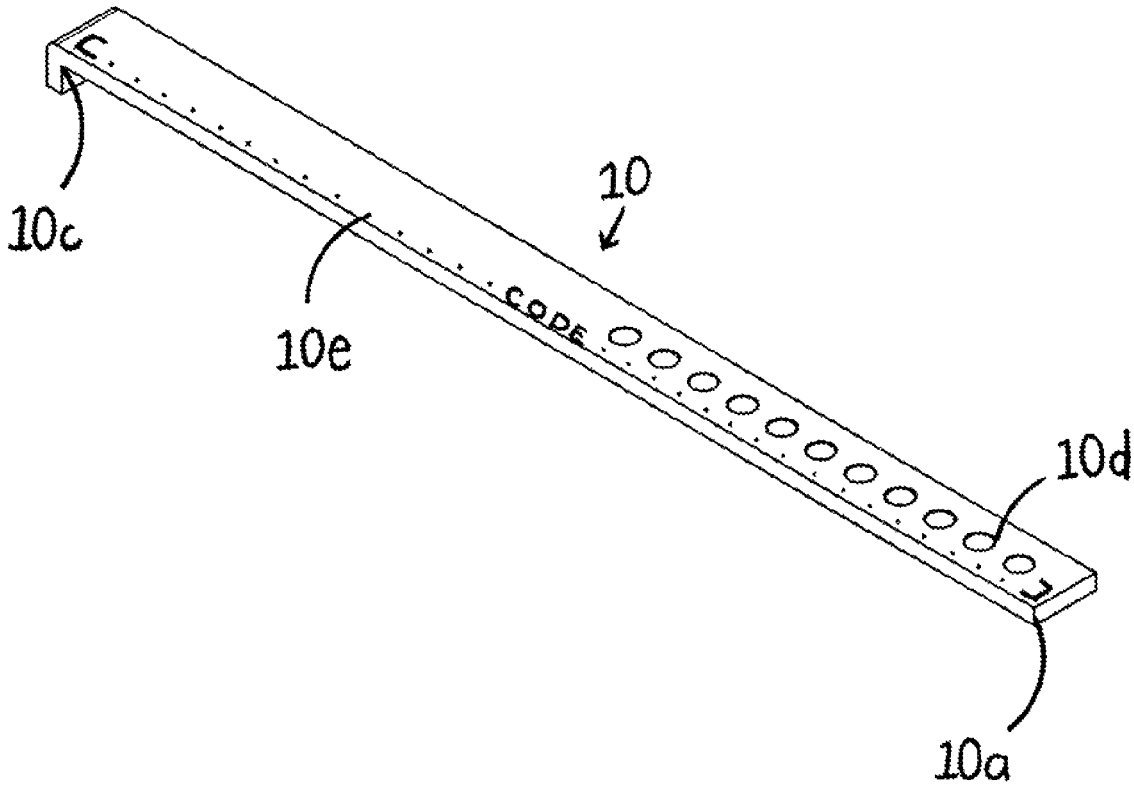
FIG. 2 shows a perspective view of an elongated bar used with the present invention.
Figure 3:
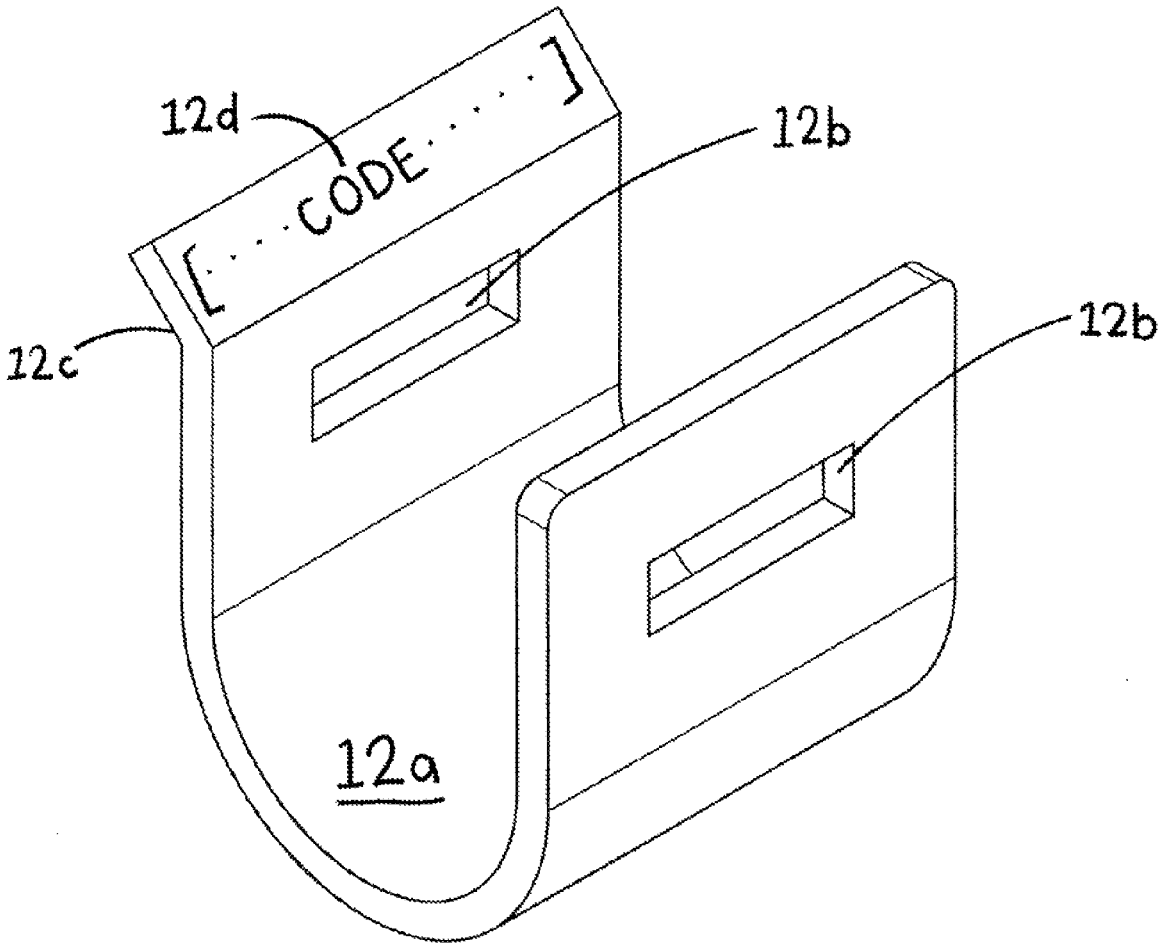
FIG. 3 shows a perspective view of a U-shaped bracket used with the present invention.
Figure 4:
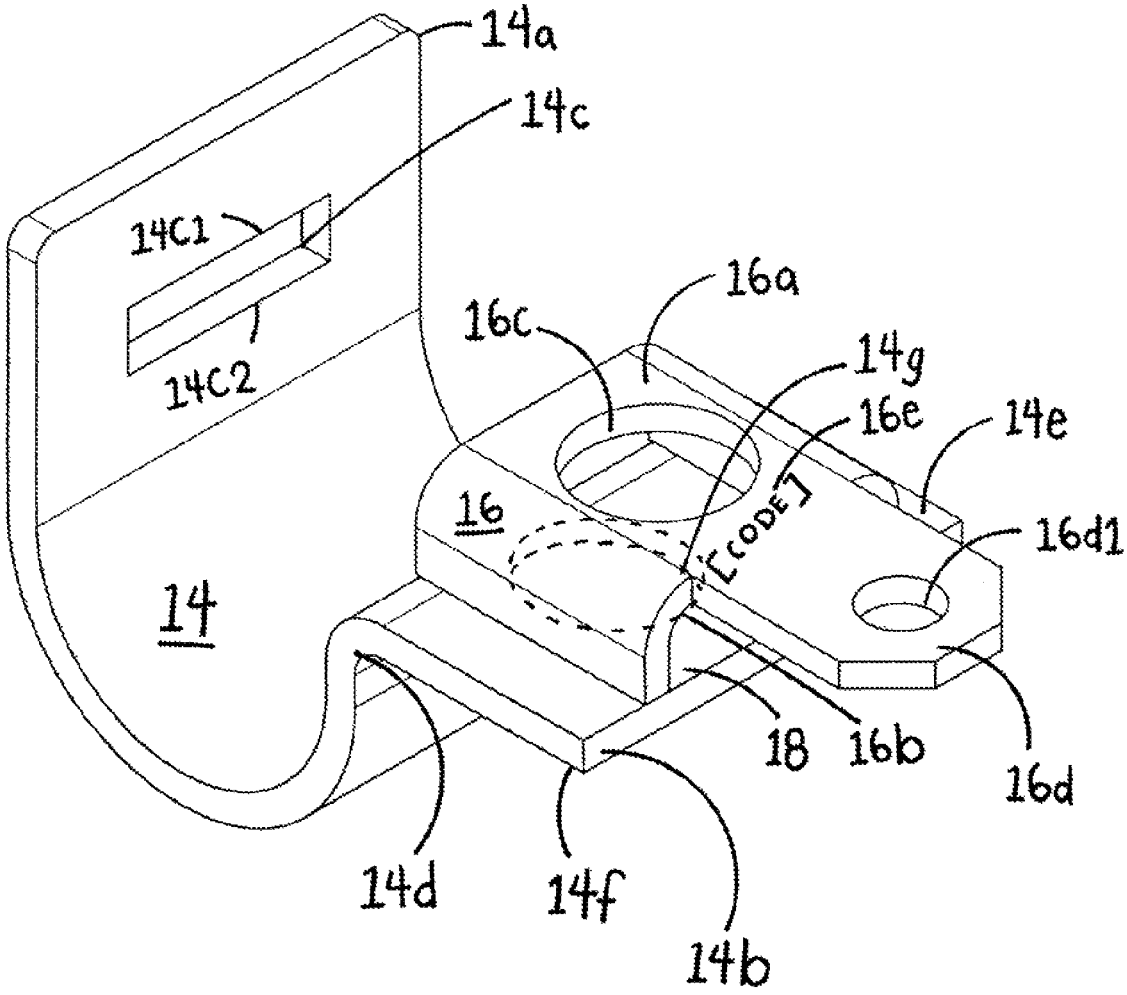
FIG. 4 shows a perspective view of the locking bracket used with the present invention.
Figure 7:
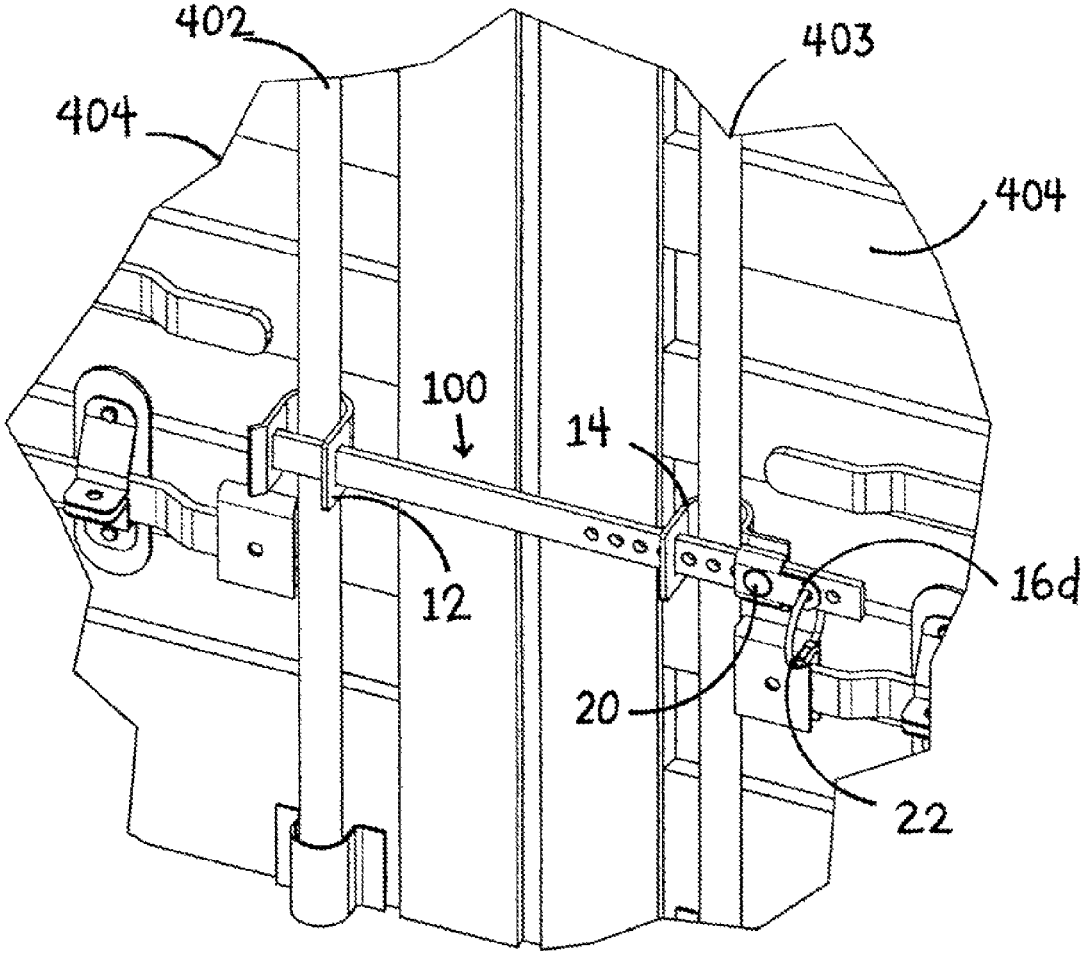
FIG. 7 shows perspective view of the first embodiment of the present invention, wherein the bar seal is fixedly attached to a shipping container.
Figure 8:
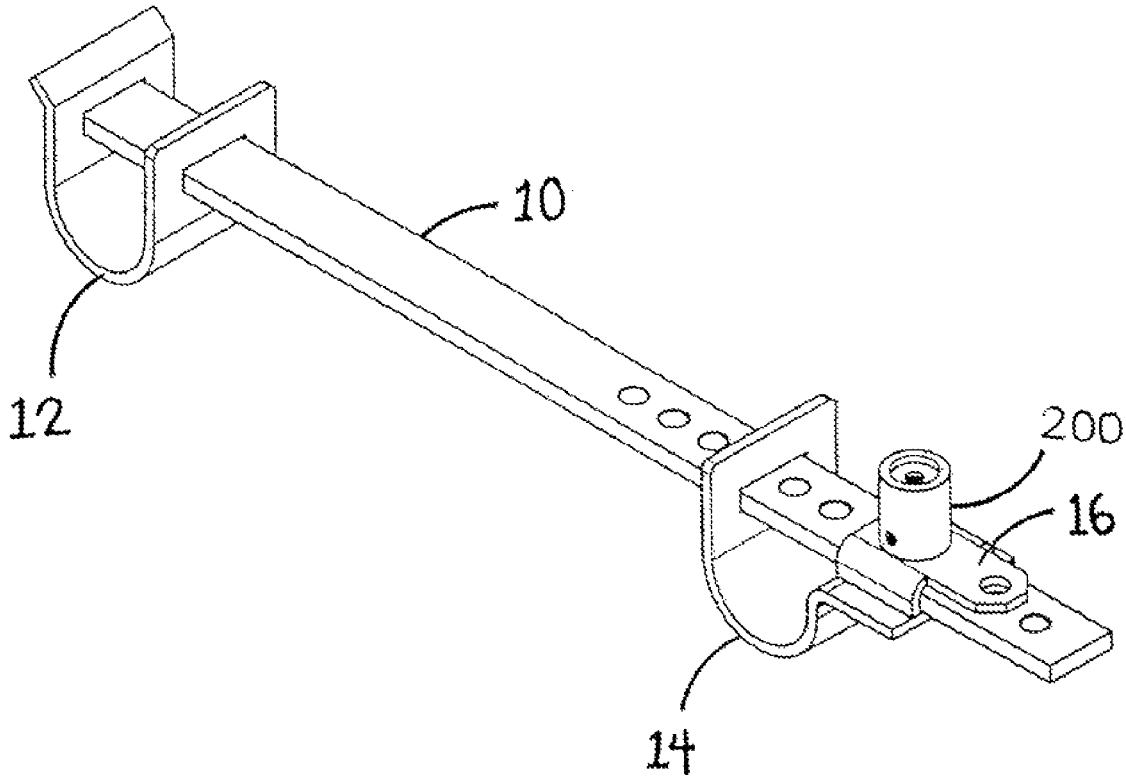
FIG. 8 shows a perspective view of a second embodiment of the present invention, wherein a push lock is used as the locking means.
Figure 9:
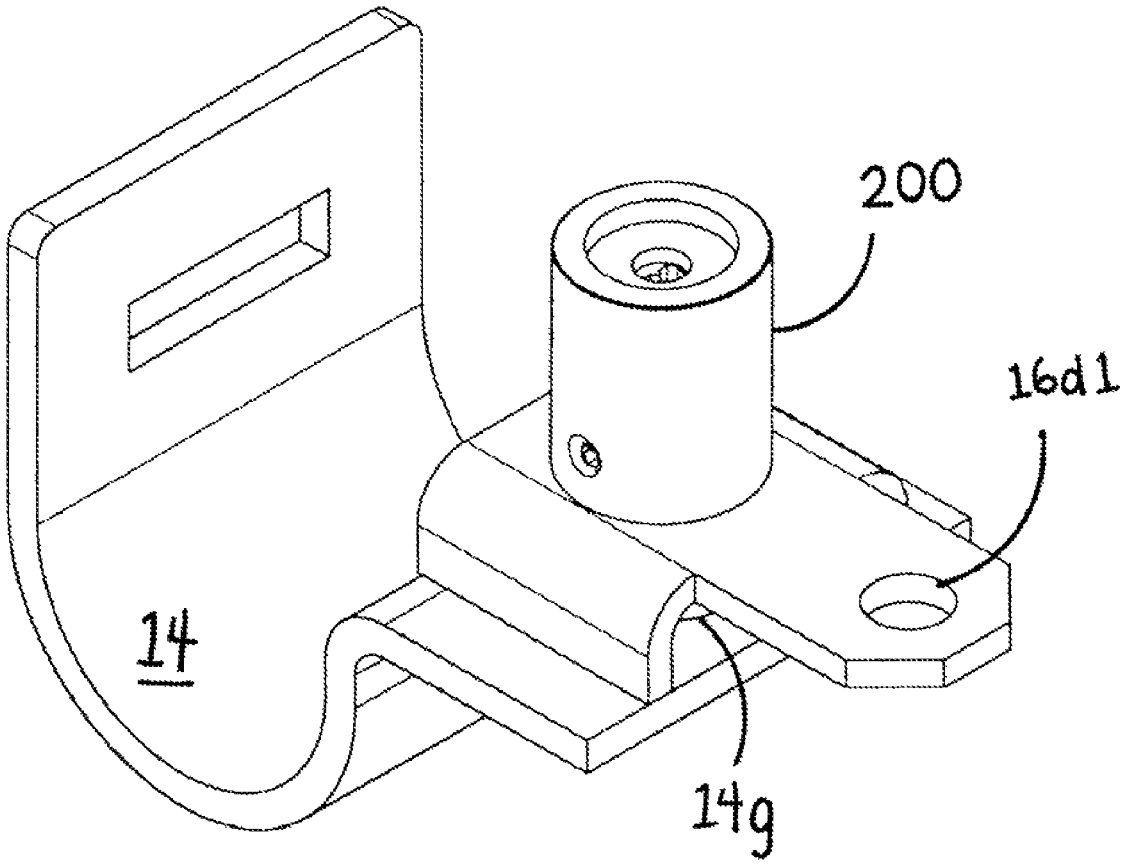
FIG. 9 shows a perspective view of the second embodiment, wherein the lock is shown attached to the mount of the present invention.
Figure 10:
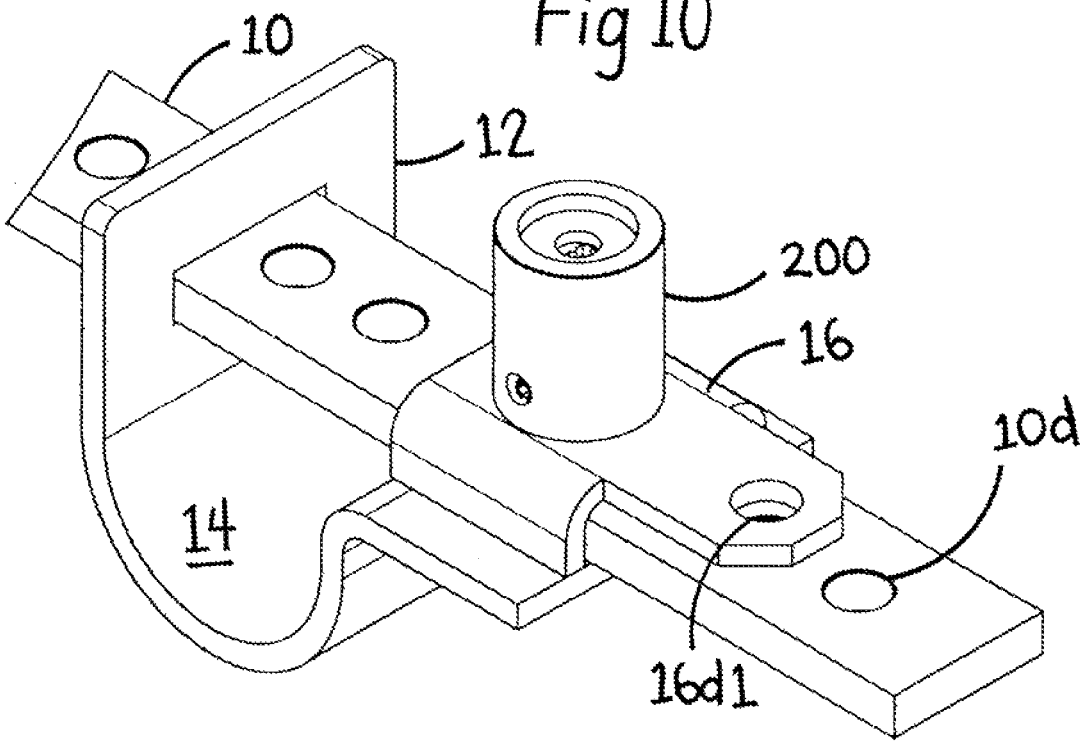
FIG. 10 shows a perspective view of the elongated bar mounted on the locking bracket of the second embodiment of the present invention.
Figure 11:
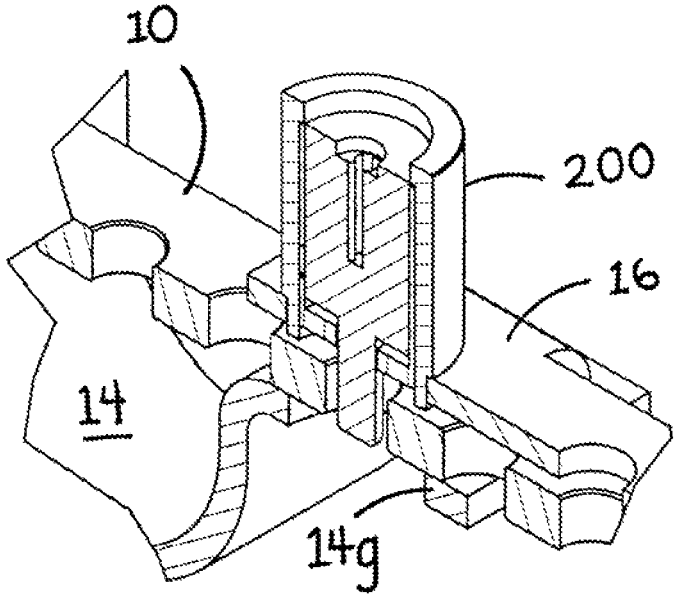
FIG. 11 shows a cross sectional view of the elongated bar mounted on the locking bracket of the present invention, wherein a push lock functions as the locking means of the second embodiment.
Figure 12:
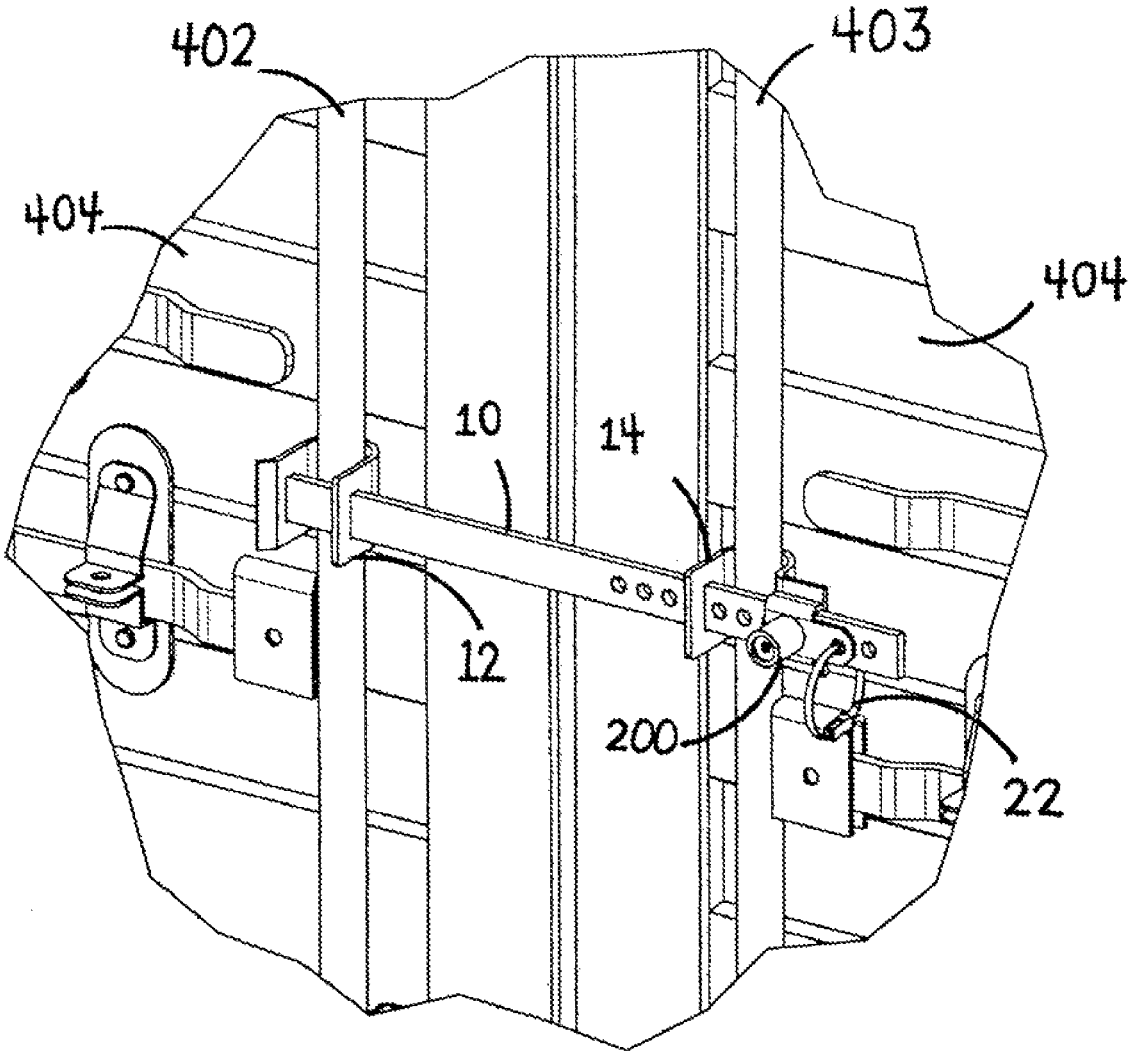
FIG. 12 shows perspective view of the second embodiment of the present invention, wherein the bar seal is fixedly attached to a shipping container.

As seen in FIGS. 1-4 a bar seal 100 for shipping containers, comprising elongated bar 10, a U-shaped bracket 12, a locking bracket 14, a mount 16, and a locking means 20/200 for locking the bar seal 100 after the bar seal has been placed on a container.

The elongated bar 10 has a first 10*a* and a second end 10*b*, the second end 10*b* of the bar 10 is bent at an angle 10*c* that is perpendicular to the bar 10, the first end 10*a* of the elongated bar 10 defines a plurality of apertures 10*d* centrally positioned on the bar 10 and running from the first end 10*a* of the bar toward the second end 10*b* of the bar, the elongated bar 10 is stamped 10*e* with words running from the second end 10*b* toward the first end 10*a* and one of the words being a code, thereby allowing any user of the elongated bar to identify any tampering with the elongated bar. The user would identify tampering by seeing welds running across the stamped code.

The U-shaped bracket 12 defines two U-shaped bracket apertures 12*b* that are coplanar and parallel to each other and have a width and height that allows the elongated bar 10 to pass trough the U-shaped bracket apertures 12*b*, the U-shaped bracket apertures 12*b* are adjacent to the ends of the U, the U-shaped bracket 12 defines a lip 12*c* and the lip is stamped 12*d* with a code, the elongated bar 10 is slideably mounted on the U-shaped bracket 12.

The locking bracket 14 is semi-U-shaped and has a first 14*a* and a second end 14*b*, the first end 14*a* defines a locking bracket aperture 14*c* that is adjacent to the first end 14*a* and has a width and height that allows the bar 10 to pass through, the locking bracket aperture 14*c* has a top 14*c*1 and a bottom 14*c*2, the second end 14*b* is bent 14*d* perpendicularly outward from the first end 14*a* so that the second end 14*b* of the locking bracket 14 is substantially coplanar with the bottom of the locking bracket aperture 14*c*2, the second end 14*b* of the locking bracket 14 has an upper 14*e* and a lower side 14*f*, the second end 14*b* of the locking bracket 14 further comprises of a centrally positioned receiver 14*g*.

The mount 16 has an upper 16*a* and a lower side 16*b*, the mount 16 defines a centrally positioned mount aperture 16*c* and a protrusion 16*d* that runs flush with the upper side 16*a* of the mount 16, the protrusion 16*d* defines a protrusion aperture 16*d*1, the mount 16 is stamped 16*e* with a code, the lower side of the mount 16*b* is fixedly attached to the second end 14*b* of the locking bracket 14 so that a channel 18 is defined between the mount 14 and the locking bracket 16 and the channel 18 defined is coplanar and parallel to the locking bracket aperture 16*c*, the elongated bar 10 is slideably mounted on the locking bracket 14 and the mount 16.

And, the locking means 20/200 is attached to the mount 16 and is locked to the receiver 14*g* alter the elongated bar 10 is passed through the channel 18.

The bar seal 100 is made of steel, the steel might be galvanized. In one embodiment of the present invention, the elongated bar 10, the U-shaped bracket 12, and the locking bracket 14 might be made of different colors of steel.

In a further embodiment of the present invention, the locking means is a pin 20.

In another embodiment of the present invention, the locking mechanism is a push lock 200.

In a further embodiment of the present invention, the bar seal 100 for shipping containers further comprises of a temporary seal 22, the temporary seal 22 would be used by placing the temporary seal 22 through the protrusion aperture 16*d*1 of the mount 16 and one of the elongated bar apertures 10*d*.

The bar seal 100 for shipping containers of the present invention is used by first providing the bar seal 100. Then, providing a shipping container, the shipping container has two doors and each door has a bar lock. Next, placing the U-shaped bracket on one of the bar locks of the shipping container so that the ends of the U-shaped bracket point outward from the container. Then, sliding the elongated bar through the U-shaped bracket aperture of the U-shape bracket. Next, placing the locking bracket on the other bar lock of the shipping container so that the ends of the locking bracket point outward from the container. Then, sliding the elongated bar through the locking bracket aperture and the mount. Lastly, applying the locking means.

In another embodiment of the method of use of the present invention, the method would further comprise the steps of providing a temporary seal and placing the temporary seal through the protrusion aperture and one of the elongated bar apertures.

An advantage of the present invention is that it provides shippers with a unique marking mechanism.

Another advantage of the present invention is that it provides shippers with a reusable bar seal when shipping containers by land.

A further advantage of the present invention is that it allows shippers the ability to attach a temporary seal to reusable or one way bar seals.

Still a further advantage of the present invention is that it allows shippers to identify tampering with bar seals of shipping containers.

Although the present invention has been described in considerable detail with reference to certain preferred versions thereof, other versions are possible. Therefore the spirit and the scope of the claims should not be limited to the description of the preferred versions contained herein.

What is claimed is:

1. A bar seal made of steel for shipping containers, comprising:

an elongated bar having a first and a second end, the second end of the bar is bent at an angle that is perpendicular to the bar, the first end of the elongated bar defines a plurality of apertures centrally positioned on the bar and running from the first end of the bar toward the second end of the bar, the elongated bar is stamped with words running from the second end toward the first end and one of the words being a code, thereby allowing any user of the elongated bar to identify any tampering with the elongated bar;

a U-shaped bracket, the U-shaped bracket defines two U-shaped bracket apertures that are coplanar and parallel to each other and have a width and height that allows the elongated bar to pass trough the U-shaped bracket apertures, the U-shaped bracket apertures are adjacent to the ends of the U, the U-shaped bracket defines a lip and the lip is stamped with a random code, the elongated bar is slideably mounted on the U-shaped bracket;

a locking bracket, the locking bracket is semi-U-shaped and has a first and a second end, the first end defines a locking bracket aperture that is adjacent to the first end and has a width and height that allows the bar to pass through, the locking bracket aperture has a top and a bottom, the second end is bent perpendicularly outward from the first end so that the second end of the locking bracket is substantially coplanar with the bottom of the aperture, the second end of the locking bracket has an upper and a lower side, the second end of the locking bracket further comprises of a centrally positioned receiver, wherein the elongated bar, the U-shaped bracket, and the locking bracket are made of different colors of steel;

a mount, the mount has an upper and a lower side, the mount defines a centrally positioned mount aperture and a protrusion that runs flush with the upper side of the mount, the protrusion defines a protrusion aperture, the mount is stamped with a random code, the lower side of the mount is fixedly attached to the second end of the locking bracket so that a channel is defined between the mount and the locking bracket and the channel defined is coplanar and parallel to the locking bracket aperture, the elongated bar is slideably mounted on the locking bracket and the mount;

a locking means for locking the bar seal after the bar seal has been placed on a container, the locking means is attached to the mount and is locked to the receiver after the elongated bar is passed through the channel, and the locking means is a push lock; and a temporary seal, the seal is placed through the protrusion aperture of the mount and one of the elongated bar apertures.

2. A method of using the bar seal of claim 1 comprising the steps of:

providing the bar seal;

providing a shipping container, the shipping container has two doors and each door has a bar lock;

placing the U-shaped bracket on one of the bar locks of the shipping container so that the ends of the U-shaped bracket point outward from the container;

sliding the elongated bar through the U-shaped bracket apertures of the U-Shape bracket;

placing the locking bracket on the other bar lock of the shipping container so that the ends of the locking bracket point outward from the container;

sliding the elongated bar through the locking bracket aperture and the mount;

applying the locking means;

providing a temporary seal; and placing the temporary seal through the protrusion aperture and one of the elongated bar apertures.

3. A bar seal for shipping containers, comprising:

an elongated bar having a first and a second end, the second end of the bar is bent at an angle that is perpendicular to the bar, the first end of the elongated bar defines a plurality of apertures centrally positioned on the bar and running from the first end of the bar toward the second end of the bar, the elongated bar is stamped with words running from the second end toward the first end and one of the words being a code, thereby allowing any user of the elongated bar to identify any tampering with the elongated bar;

a U-shaped bracket, the U-shaped bracket defines two U-shaped bracket apertures that are coplanar and parallel to each other and have a width and height that allows the elongated bar to pass trough the U-shaped bracket apertures, the U-shaped bracket apertures are adjacent to the ends of the U, the U-shaped bracket defines a lip and the lip is stamped with a random code, the elongated bar is slideably mounted on the U-shaped bracket;

a locking bracket, the locking bracket is semi-U-shaped and has a first and a second end, the first end defines a locking bracket aperture that is adjacent to the first end and has a width and height that allows the bar to pass through, the locking bracket aperture has a top and a bottom, the second end is bent perpendicularly outward from the first end so that the second end of the locking bracket is substantially coplanar with the bottom of the aperture, the second end of the locking bracket has an upper and a lower side, the second end of the locking bracket further comprises of a centrally positioned receiver;

a mount, the mount has an upper and a lower side, the mount defines a centrally positioned mount aperture and a protrusion that runs flush with the upper side of the mount, the protrusion defines a protrusion aperture, the mount is stamped with a random code, the lower side of the mount is fixedly attached to the second end of the locking bracket so that a channel is defined between the mount and the locking bracket and the channel defined is coplanar and parallel to the locking bracket aperture, the elongated bar is slideably mounted on the locking bracket and the mount;

a locking means for locking the bar seal after the bar seal has been placed on a container, the locking means is attached to the mount and is locked to the receiver after the elongated bar is passed through the channel, and the locking means is a pin; and a temporary seal, the seal is placed through the protrusion aperture of the mount and one of the elongated bar apertures.

4. A bar seal made of steel for shipping containers, comprising:

an elongated bar having a first and a second end, the second end of the bar is bent at an angle that is perpendicular to the bar, the first end of the elongated bar defines a plurality of apertures centrally positioned on the bar and running from the first end of the bar toward the second end of the bar, the elongated bar is stamped with words running from the second end toward the first end and one of the words being a code, thereby allowing any user of the elongated bar to identify any tampering with the elongated bar;

a U-shaped bracket, the U-shaped bracket defines two U-shaped bracket apertures that are coplanar and parallel to each other and have a width and height that allows the elongated bar to pass trough the U-shaped bracket apertures, the U-shaped bracket apertures are adjacent to the ends of the U, the U-shaped bracket defines a lip and the lip is stamped with a random code, the elongated bar is slideably mounted on the U-shaped bracket;

a locking bracket, the locking bracket is semi-U-shaped and has a first and a second end, the first end defines a locking bracket aperture that is adjacent to the first end and has a width and height that allows the bar to pass through, the locking bracket aperture has a top and a bottom, the second end is bent perpendicularly outward from the first end so that the second end of the locking bracket is substantially coplanar with the bottom of the aperture, the second end of the locking bracket has an upper and a lower side, the second end of the locking bracket further comprises of a centrally positioned receiver, wherein the elongated bar, the U-shaped bracket, and the locking bracket are made of different colors of steel;

a mount, the mount has an upper and a lower side, the mount defines a centrally positioned mount aperture and a protrusion that runs flush with the upper side of the mount, the protrusion defines a protrusion aperture, the mount is stamped with a random code, the lower side of the mount is fixedly attached to the second end of the locking bracket so that a channel is defined between the mount and the locking bracket and the channel defined is coplanar and parallel to the locking bracket aperture, the elongated bar is slideably mounted on the locking bracket and the mount;

a locking means for locking the bar seal after the bar seal has been placed on a container, the locking means is attached to the mount and is locked to the receiver after the elongated bar is passed through the channel, and the locking means is a pin; and a temporary seal, the seal is placed through the protrusion aperture of the mount and one of the elongated bar apertures.

* * * * *